United States Patent [19]

Raymond

[11] 4,185,427

[45] Jan. 29, 1980

[54] DOUBLE CYLINDER OVER-CENTER AERIAL DEVICE

[75] Inventor: James W. Raymond, Duluth, Minn.

[73] Assignee: Reach-All Manufacturing & Engineering Co., Duluth, Minn.

[21] Appl. No.: 911,340

[22] Filed: Jun. 1, 1978

[51] Int. Cl.[2] ..... E04H 12/34

[52] U.S. Cl. ..... 52/115; 52/117

[58] Field of Search ..... 52/115, 116, 117; 182/2

[56] References Cited

U.S. PATENT DOCUMENTS

| | | | |
|---|---|---|---|
| 3,467,217 | 9/1969 | Zwight | 182/46 X |
| 3,809,180 | 5/1974 | Grove | 182/2 |
| 3,834,488 | 9/1974 | Grove | 182/2 |
| 3,841,436 | 10/1974 | Grove | 182/2 |
| 3,888,317 | 6/1975 | Walters | 52/115 X |
| 3,937,340 | 2/1976 | Grove | 182/2 X |
| 4,074,821 | 2/1978 | Long | 214/138 R |

*Primary Examiner*—Carl D. Friedman

*Attorney, Agent, or Firm*—Kinney, Lange, Westman & Fairbairn

[57] ABSTRACT

An aerial device includes a boom support structure, a boom pivotally secured to the support structure, and first and second boom lift hydraulic actuators. The first and second boom lift hydraulic actuators are operated in tandem to raise, lower, and hold the boom in position. The first and second boom lift hydraulic actuators are pivotally connected between the boom support structure and the boom and are disposed with respect to the boom pivot axis so that regardless of boom position, one of the first and second actuators is under tension and the other is under compression. This eliminates the danger of loss of lift of the boom caused by end gland failure of a lift actuator.

6 Claims, 3 Drawing Figures

DOUBLE CYLINDER OVER-CENTER AERIAL DEVICE

BACKGROUND OF THE INVENTION

The present invention relates to aerial devices such as aerial platforms. In particular, the present invention is an aerial device which provides improved safety in raising, lowering, and holding a boom position.

Aerial platforms have found wide use, particularly by public utilities because they enable a workman to have access to overhead power lines, street fixtures, pole-mounted transformers, and other locations remote from the ground. Many of these devices are mounted on the bed of a truck so that they are easily moved from one location to another. The devices typically include a boom, a workman's platform or basket, and a hydraulic control system for raising and lowering the boom and pivoting the platform to maintain the platform level. In some cases, the device includes only a single boom, while other devices have articulated booms with several sections.

Most aerial devices use a hydraulic actuator to raise or lower a boom. It is extremely important that the hydraulic actuator maintain its hydraulic pressure and not collapse while the boom is in an elevated position. This clearly would present a dangerous situation for a workman in the platform or basket.

When a hydraulic actuator, which typically includes a cylinder and a hydraulic piston, is in compression, there is less danger of a loss in hydraulic pressure than when the actuator is in tension. This is because the actuator, when in tension, is relying upon the end seal through which the piston rod extends out of the cylinder to hold pressure. The failure of this seal, which is termed "end gland failure" will cause collapse of the cylinder, and therefore the boom, if the cylinder is holding the boom in position while in tension rather than in compression. The likelihood of leakage and loss of pressure is greatly reduced when the actuator is in compression because there is no similar seal at the opposite end of the cylinder. The only possible leakage is past the piston itself or through the connection of the hydraulic lines to the cylinder.

SUMMARY OF THE INVENTION

The present invention is an improved aerial device which provides greater safety by reducing the risk of collapse of the boom due to failure of a hydraulic lift actuator. The aerial device of the present invention includes a boom support structure, a boom pivotally secured to the support structure, first and second boom lift hydraulic actuators, a source of hydraulic fluid under pressure, and control means for controlling hydraulic fluid pressure to the first and second actuators.

In the present invention, the first and second boom lift hydraulic actuators are controlled in tandem for raising, lowering, and holding the boom in position. The first and second actuators are pivotally connected between the boom support structure and the boom, and are disposed with respect to the boom pivot axis so that regardless of boom position, one of the first and second actuators is under tension and the other is under compression. Even in the event of end gland failure of the actuator under tension, the actuator then under compression holds the boom in position and prevents a catastrophic collapse of the boom.

DETAILED DESCRIPTION OF THE PREFERRED EMBODIMENTS

Figure 1A:
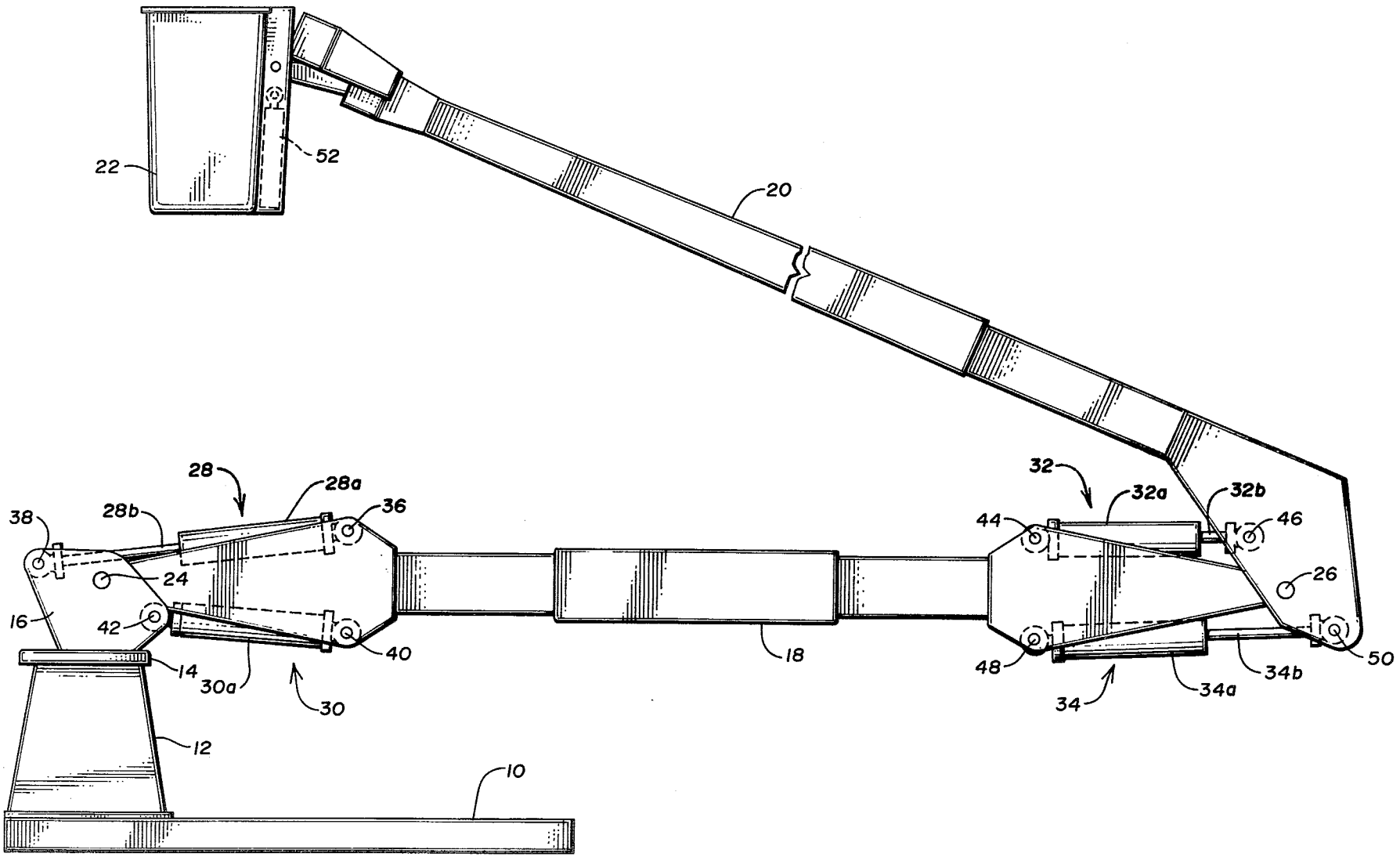
FIGS. 1A and 1B show a preferred embodiment of an over-center aerial device with its boom in two different possible positions to illustrate the operation of the present invention.
Figure 1B:
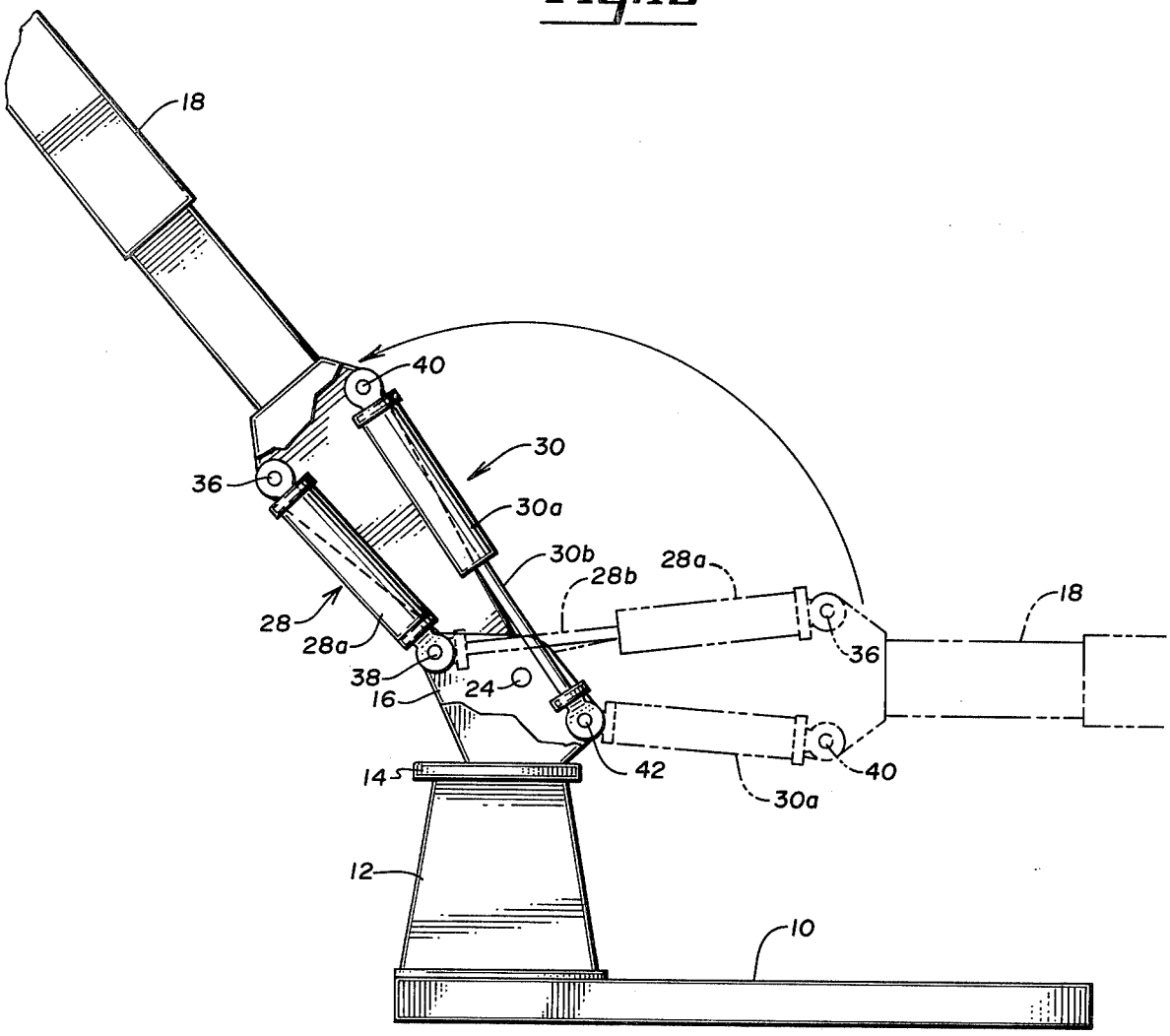

FIGS. 1A and 1B show a preferred embodiment of the aerial device of the present invention. The device includes a boom support structure formed by subframe 10, pyramid-shaped base 12, rotation assembly 14, and base bracket 16. Subframe 10 is, in a preferred embodiment, fixedly attached to a bed of a truck or other motor vehicle. Rotator assembly 14 preferably includes a hydraulic orbit motor which drives the turntable bearing to rotate the entire boom assembly to reach various locations.

The boom structure includes lower boom 18 and upper boom 20, and a basket or platform 22. Lower boom 18 is pivotally connected to base bracket 16 at boom pivot axis 24. At its opposite end, lower boom section 18 is pivotally connected to upper boom section 20 at boom knuckle pivot axis 26. Basket 22 is pivotally connected to the opposite end of upper boom section 20 to provide clear working areas on three sides.

The raising and lowering of the boom structure is achieved by two sets of hydraulic actuators. The first set of hydraulic actuators includes main lift actuators 28 and 30, which are connected between base bracket 16 and lower boom section 18. The second set of hydraulic actuators includes knuckle actuators 32 and 34.

Figure 2:
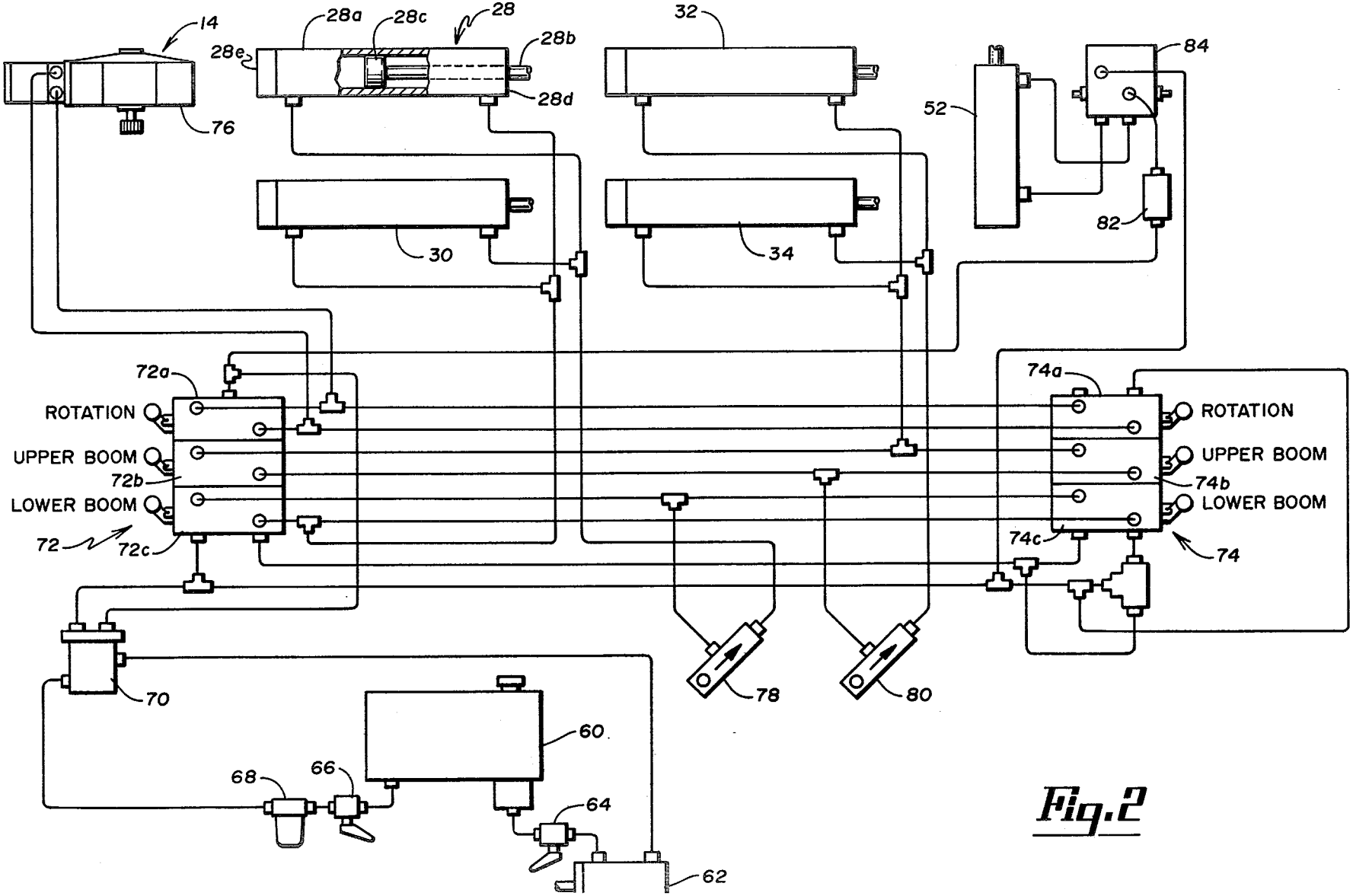
FIG. 2 is a schematic hydraulic circuit diagram of a hydraulic system used in conjunction with the over-center aerial device of FIGS. 1A and 1B.

Main lift actuator 28 includes a hydraulic cylinder **28*a*, a piston rod 28*b*, and a piston 28*c* (shown in FIG. 2). Piston rod 28*b* extends out of cylinder 28*a* through end 28*d*, which typically includes packing (not shown) to provide an end seal. The opposite end 28*e*** is completely closed, since no piston rod extends through it.

Cylinder **28*a* is pivotally connected to lower boom section 18 at pivot point 36, while the end of piston rod 28*b* is pivotally connected to base bracket 16 at pivot point 38. Similarly, main lift actuator 30 includes cylinder 30*a* and piston rod 30*b*. Cylinder 30*a* is pivotally connected to lower boom section 18 at pivot point 40, and piston rod 30*b* is pivotally connected to base bracket 16 at pivot point 42**.

At the knuckle between lower and upper boom sections 18 and 20, similar connections of actuators 32 and 34 are made. Cylinder **32*a* is connected to lower boom section 18 at pivot point 44, and piston rod 32*b* is connected to upper boom section 20 at pivot point 46. Cylinder 34*a* is connected to lower boom section 18 at pivot point 48, and piston rod 34*b* is connected to upper boom section 20 at pivot point 50**.

The arrangement of actuators 28 and 30 (and also actuators 32 and 34) provides an important improvement in the safety over the aerial devices of the prior art. Actuators 28 and 30 are positioned in opposite sides of boom pivot axis 24 so that regardless of boom position, one of the two actuators will be in compression. As long as one of the lift actuators is in compression, the danger of boom collapse due to end gland failu of one actuator is essentially eliminated. FIGS. 1A and 1B illustrate how the particular actuator that is in compression will vary depending upon boom position. In FIG. 1A (and in the phantom view in FIG. 1B) actuator 30 is in compression and actuator 28 is in tension. in FIG. 1B, on the other hand, actuator 28 is in compression and actuator 30 is in tension.

Actuators 32 and 34 operate in a similar manner in that one actuator is always in compression, while the other actuator is in tension. In most, if not all, useable positions of the boom in the embodiment shown in FIGS. 1A and 1B, actuator 32 will be in compression, while actuator 34 will be in tension.

Raising and lowering of the boom structure is achieved by a hydraulic control system, which simultaneously operates actuators 28 and 30 in tandem, and simultaneously operates actuators 32 and 34 in tandem. In addition, the control system controls the operation of rotator assembly 14 and of a hydraulic actuator 52 connected between upper boom section 20 and basket 22, which is used to level basket 22.

FIG. 2 shows a schematic diagram of the hydraulic control system used in one preferred embodiment of the invention. In the control system of FIG. 2, the source of hydraulic fluid pressure includes reservoir 60, pump 62, valves 64 and 66, filter assembly 68, and hydraulic swivel 70. The fluid pressure is supplied from hydraulic swivel 70 to hydraulic controls 72 and 74. Controls 72 include operator controlled valves **72*a*, 72*b*, and 72*c* which control rotation, operation of the upper boom, and operation of the lower boom, respectively. Valves 72*a*–72*c* are controlled by movable levers or wheels which are moved by an operator. Control assembly 72 is preferably located on or near the base 12**.

Controls 74 are located in the basket 22 and include valves **74*a*, 74*b*, and 74*c*. These three valves, 74*a*, 74*b*, and 74*c*, control the same functions as valves 72*a*–72*c*, and as shown in FIG. 2 they are connected in parallel with one another. This permits operation of the boom device either from the base 12 on the truck or from the basket 22 itself. In a preferred embodiment, the controls at the base 12 override the controls on basket 22**.

As shown in FIG. 2, controls **72*a* and 74*a* control the hydraulic lines to hydraulic orbit motor 76 of rotation assembly 14. Depending upon the position of the current lever or wheel of either control 72*a* or 74*a*, fluid pressure will be supplied to orbit motor 76** to rotate the entire boom structure or to hold the structure at a particular rotated position.

Controls **72*b* and 74*b* control actuators 32 and 34. It can be seen that the connections of the hydraulic lines are such that when fluid pressure is being supplied to one side of the pistion of actuator 32, pressure is being released from that same side of the piston of actuator 34**. The two cylinders are operated in tandem with one driving piston in one direction while the other drives the piston in the opposite direction each time that a change in boom position is called for.

A similar arrangement is provided with actuators 28 and 30. These two actuators are controlled by lower boom controls **72*c* and 74*c*. As in the case of actuators 32 and 34**, each time a change in lower boom position is called for, one of the actuators is supplied fluid pressure to drive the piston outward, while the other actuator is supplied fluid pressure to drive the piston inward.

FIG. 2 shows over-center valves 78 and 80, which limit the extent to which the upper and lower booms may be driven. Also shown in FIG. 2 is the hydraulic control circuitry which drives basket leveling actuator 52 to level basket 22 automatically when any control 72 or 74 is activated. This control circuitry includes control regulator 82 and basket leveling valve 84.

In conclusion, the present invention is an improved aerial device which provides greater safety by the use of two cylinders positioned on opposite sides of a pivot axis and operated in tandem, the danger of collapse of the boom as a result of end gland failure of a hydraulic actuator is eliminated. The present invention provides that one of the two actuators used for lifting, lowering, and holding the boom in position is always in compression, regardless of the position of the boom.

Although some of the prior art systems show two hydraulic cylinders attached between a boom and a base (such as those systems described in the following U.S. Pat. Nos.: Zwight 3,467,217; Grove 3,809,180; Grove 3,834,488; Grove 3,841,436; and Grove 3,937,340), only one of the hydraulic cylinders is used in the actual lifting, lowering and holding of the boom in position. The other cylinder is used in the hydraulic control system to automatically level the operator basket or platform. As a result, in these prior art systems the danger of end gland failure and a collapse of the boom can occur depending upon the position of the boom.

Although the present invention has been described with reference to preferred embodiments, workers skilled in the art will recognize that changes may be made in form and detail without departing from the spirit and scope of the invention.

What is claimed is:

1. An aerial device comprising:

a boom support structure;

a boom pivotally secured to the support structure by pivotal means defining a substantially horizontal boom pivot axis;

a first boom lift hydraulic actuator for raising, lowering, and holding the boom in position, the first actuator extending between the support structure and the boom and having a piston rod and a cylinder, one of which is pivotally connected to the support structure and the other of which is pivotally connected to the boom;

a second boom lift hydraulic actuator for raising, lowering, and holding the boom in position, the second actuator extending between the support structure and the boom and having a piston rod and a cylinder, one of which is pivotally connected to the support structure and the other of which is pivotally connected to the boom;

the pivotal connections of the first and second actuators, respectively, to the support structure and to the boom being so disposed with respect to the boom pivot axis that regardless of boom position, one of the first and second actuators is under tension and the other is under compression due to the load of the boom;

a source of hydraulic fluid under pressure; and control means for controlling hydraulic fluid pressure to the first and second actuators to cause the first and second actuators to operate in tandem in raising, lowering, and holding the boom in position.

2. The aerial device of claim 1 wherein the control means, under a first controlling condition thereof, causes fluid to be admitted from the source to one side of the piston of the first actuator and to be released from one side of the piston of the second actuator, and under a second controlling condition causes fluid to be released from the one side of the piston of the first actuator and to be admitted to the one side of the piston of the second actuator.

3. The aerial device of claim 1 wherein the boom comprises first and second boom sections, the first boom section being pivotally secured to the support structure at the boom pivot axis and being pivotally connected to the second boom section at a boom knuckle pivot axis.

4. The aerial device of claim 3 and further comprising:

a third boom lift hydraulic actuator for raising, lowering and holding the second boom in position, the third actuator extending between the first and second boom sections and having a piston rod and a cylinder, one of which is pivotally connected to the first boom section and the other of which is pivotally connected to the second boom section;

a fourth boom lift hydraulic actuator for raising, lowering, and holding the second boom in position, the fourth boom lift hydraulic actuator extending between the first and second boom sections and having a piston rod and a cylinder, one of which is pivotally connected to the first boom section and the other of which is pivotally connected to the second boom section; and the pivotal connections of the third and fourth actuators, respectively, to the first and second boom sections being so disposed with respect to the boom knuckle pivot axis that regardless of second boom section position one of the third and fourth actuators is under tension and the other is under compression.

5. The aerial device of claim 4 wherein the control means controls hydraulic fluid pressure to the third and fourth actuators to cause the third and fourth actuators to operate in tandem in raising, lowering and holding the second boom section in position with respect to the first boom section.

6. An over-center serial device comprising:

a boom support structure;

a boom pivotally secured to said support structure by pivotal means defining a pivot axis;

first and second hydraulic actuators extending between said support structure and said boom and each having a piston rod and a cylinder, one of which is pivotally connected to said support structure and the other of which is pivotally connected to said boom;

the pivotal connections of said first actuator being so disposed that a line passing therethrough passes on one side of said pivot axis and the pivotal connections of said second actuator being so disposed that a line passing therethrough passes on the other side of said pivot axis;

a source of hydraulic fluid under pressure; and control means effective under one controlling condition thereof to cause fluid to be admitted from said source to one side of the piston of said first actuator and to be released from said one side of the piston of the second actuator and under a second controlling condition thereof to cause fluid to be released from said one side of the piston of said first actuator and to be admitted from said source to said one side of the second actuator so that whenever said boom is disposed on either side of a vertical line extending through said pivot axis, one of said hydraulic actuators is under tension and the other is under compression due to the load of the boom.

* * * * *